US005839137A

United States Patent [19]

Butler et al.

[11] Patent Number: 5,839,137

[45] Date of Patent: Nov. 24, 1998

[54] ROLL UP EMERGENCY PERSONNEL CARRIER

[76] Inventors: Robert O. Butler; Kathleen W. Butler, both of 509 Lantana Dr., Port Aransas, Tex. 78373

[21] Appl. No.: 968,101

[22] Filed: Nov. 12, 1997

[51] Int. Cl.[6] ..... A61G 1/01

[52] U.S. Cl. ..... 5/627; 5/620; 5/89.1

[58] Field of Search ..... 5/81.1 T, 89.1, 5/625, 627, 628

[56] References Cited

U.S. PATENT DOCUMENTS

| | | | |
|---|---|---|---|
| 2,279,694 | 4/1942 | Martinson | 5/627 |
| 2,489,828 | 11/1949 | Springer | 5/627 |
| 2,788,530 | 4/1957 | Ferguson | 5/628 |
| 3,829,914 | 8/1974 | Treat | 5/81.1 T |
| 4,283,068 | 8/1981 | Keyser | 280/19 |
| 4,442,557 | 4/1984 | Clemens | 5/82 R |
| 4,841,961 | 6/1989 | Burlage et al. | 5/628 X |
| 5,050,254 | 9/1991 | Murphy | 5/82 R |
| 5,150,487 | 9/1992 | Hemphill | 5/625 |
| 5,189,746 | 3/1993 | Horie | 5/627 |
| 5,214,813 | 6/1993 | Gastle et al. | 5/625 |
| 5,729,850 | 3/1998 | Eskeli | 5/627 X |

FOREIGN PATENT DOCUMENTS

| | | | |
|---|---|---|---|
| 2023010 | 12/1979 | United Kingdom | 5/81.1 T |

*Primary Examiner*—Michael F. Trettel
*Attorney, Agent, or Firm*—G. Turner Moller

[57] ABSTRACT

An emergency evacuation device comprises a tough fabric panel longer than a large human adult and wide enough to be wrapped around such a person. A pouch on the foot end of the device receives the person's feet. A strap adjacent the foot end of the device ties the person's feet together in an upright position so the feet do not splay apart and snag on an obstruction when the device is moved. Transverse straps wrap the panel about the individual and, at the head end of the panel, preferably are crossed to pull the person's shoulders downwardly and inwardly thereby making the person's shoulders less apt to snag on an obstruction when the device is pulled along an underlying surface.

9 Claims, 2 Drawing Sheets

10
12
14
16
18
20
22
24
26
28
30
32
34
36
38
40
42
48
50
52
56

ROLL UP EMERGENCY PERSONNEL CARRIER

This invention is a device to carry people, in an emergency situation, away from the place of their injury.

BACKGROUND OF THE INVENTION

In ordinary injury cases, the victim is placed on a back board, lifted onto a collapsible gurney and wheeled to an ambulance for a ride to the hospital. There are some situations where the victim is in a place where restricted access or rough terrain prevents use of a conventional back board and collapsible gurney. Examples are where the victim is inside a vessel in a refinery or chemical plant or where the victim is in a ravine or on other difficult terrain.

In response to this situation, equipment has been proposed to wrap an individual and a back board inside what is basically a roll up transport device. These devices have sufficient handles so a number of people can carry or pull the victim to a location where more convenient conventional means can be used to transport the victim.

Typical devices known in the prior art for this purpose are found in U.S. Pat. Nos. 2,279,694; 2,489,828; 4,186,453; 4,283,068; 4,442,557; 5,050,254; 5,150,487 and 5,214,813.

SUMMARY OF THE INVENTION

In this invention, a tough fabric panel is provided, of a size to receive a large adult human. A plurality of transverse straps are stitched to the inside of the panel to wrap the panel about the victim. The device provides a pouch at the foot end of the device for receiving the victim's feet. The victim's feet are tied together in a vertical position so the feet do not splay apart, which is an individual's natural resting posture, especially when the heels are together. A plurality of longitudinal straps are provided so the evacuation device, with the victim inside, may be pulled out of a place of restricted access or from a location of difficult terrain along an underlying surface. Suitable hand holds are provided so the roll up evacuation device, with the victim inside, can be carried by workers grasping the hand holds. Suitable attachments are provided so the evacuation device, with the victim inside, may be lifted upwardly, as by a helicopter or winch. The attachments are such that the victim can be vertical, horizontal or tilted at an angle between vertical and horizonal.

The foot pouch allows the panel to be reasonably short as compared to some of the prior art devices which are twice the height of the victim and then doubled over the victim's feet. The foot pouch prevents the victim from sliding out the foot end of the device when it is pulled along an underlying surface. By tieing the victim's feet together in an upright position, the victim's feet do not splay out and snag any obstructions when being pulled along an underlying surface so the victim remains substantially stationary inside the roll up evacuation device.

The transverse straps which secure the individual inside the roll up device of this invention include straps which are preferably crossed so the device is pulled downwardly on the victim's shoulders. This makes the victim's shoulders much less likely to snag on some obstruction if the device is towed on an underlying surface.

It is an object of this invention to provide an improved emergency evacuation device.

Another object of this invention is to provide an evacuation device in which a back board and victim may be rolled up inside and transported away from an injury location in a quick and expeditious manner.

A further object of this invention is to provide an evacuation device in which the victim is restrained inside and prevented from sliding toward the foot end of the device when being pulled away from an injury location.

These and other objects and advantages of this invention will become more apparent as this description proceeds, reference being made to the accompanying drawings and appended claims.

DETAILED DESCRIPTION

Referring to FIGS. 1–4, a roll up evacuation device 10 of this invention comprises a panel 12 of tough fabric material which has been stitched to provide a foot pouch 14 at a foot end 16. A plurality of straps are stitched to the panel 12 for holding a victim or patient inside the device 10, for pulling the victim along an underlying surface, for lifting the device 10 with the victim in it and for holding the victim's feet together so they do not splay out.

Although the panel 12 may be of any suitable stitchable material, such as heavy canvas, woven Kevlar, plastic coated sheet, or the like, it is preferably of a very tough fabric known as SPECTRA brand extended chain polyethylene fibers made by Allied Signal Corporation of Petersburg, Va. The panel 12 is as long as a tall adult human and is about half as wide as would be necessary to wrap around a person of substantial girth, the straps being used to hold the victim in the device 10. Although the length and width of the panel 12 is subject to considerable variation, about 40"×72" is quite workable.

Figures 1, 4, 5:
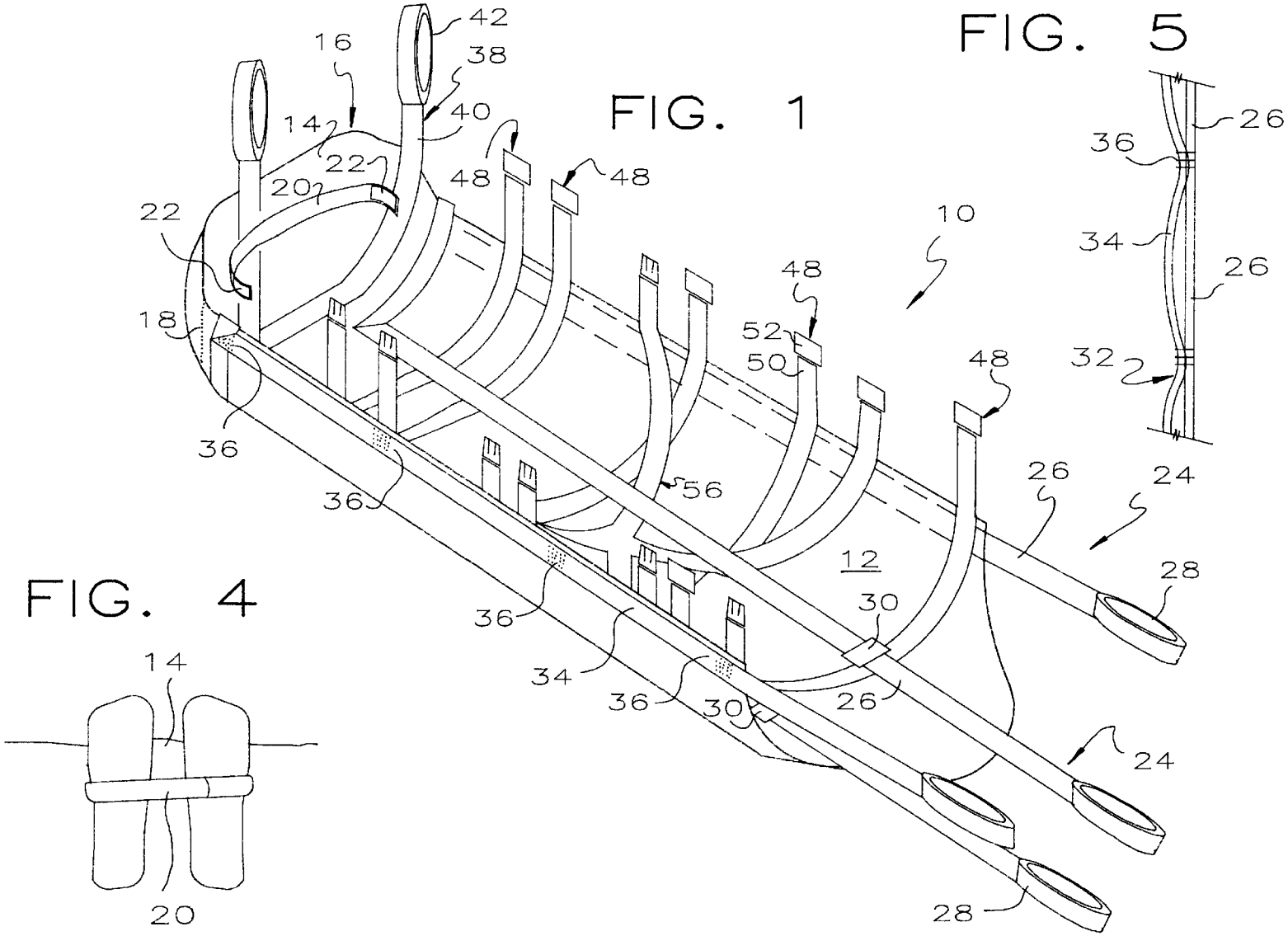
FIG. 1 is an isometric view of a roll up evacuation device in accordance with this invention.
FIG. 4 is a view, looking from the victim's head, of the victim's feet, as they are tied together in accordance with this invention.
FIG. 5 is an enlarged top view of the hand holds provided on the edge of the evacuation device of this invention.
Figure 2:
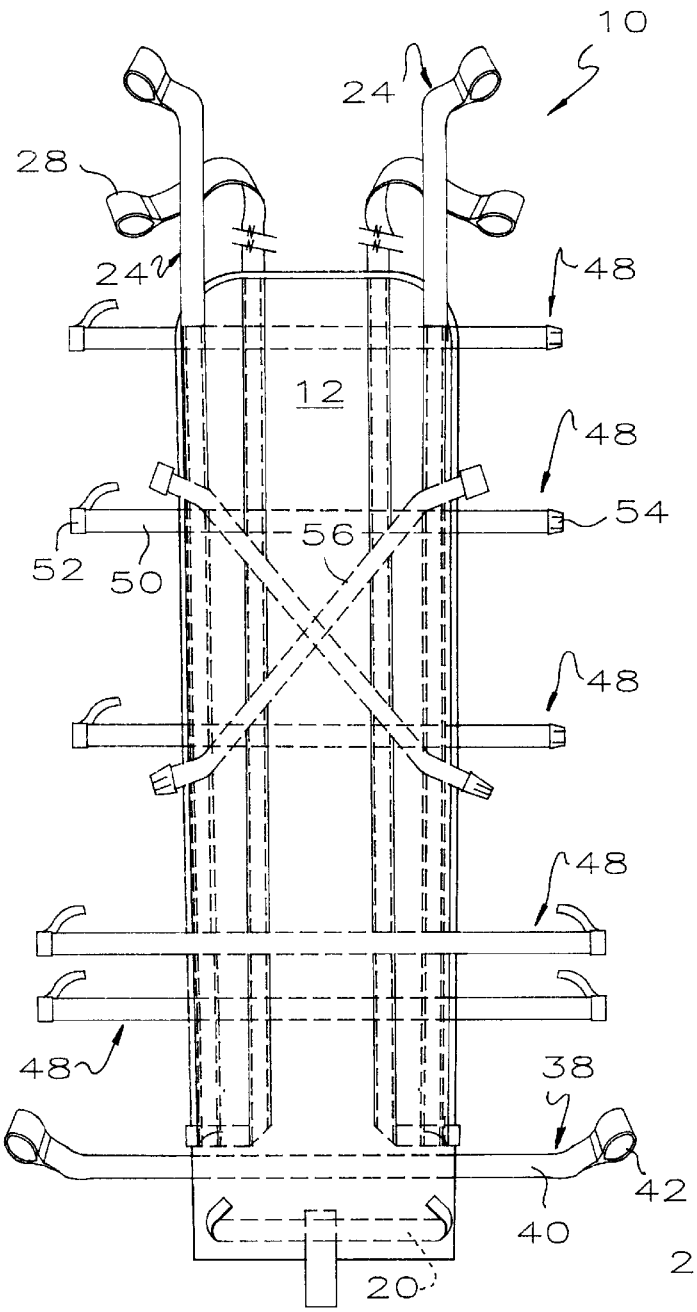
FIG. 2 is a plan view of the back of the roll up evacuation device of FIG. 1.

The foot pouch 14 is made by cutting the material of the panel 12 and stitching it along a pair of vertical seams 18. The purpose of the pouch 14 is to prevent the victim from sliding out of the foot end 16 of the device 10. Without the pouch 14, the panel 12 has to be much longer so it can be doubled over the victim. The pouch 14 is provided with a strap 20 stitched, or otherwise connected, to the panel 12 on the inside of the pouch 14 so the victim's feet can be tied together as shown in FIG. 4. The strap 20 has suitable connectors 22 such as VELCRO brand hook-and-loop fasteners strips or a buckle. In this manner, the victim's feet are prevented from splaying out and thereby avoid snagging the victim's feet on some obstruction when removing the victim from a confined location.

It is desirable to allow the victim to be carried from the place of injury in a variety of ways. The most common techniques are for workers to carry the victim manually or for workers to pull the device 10 so it slides along the underlying ground surface. A series of pulling straps 24 are provided, preferably at least two and optimally four. Each of the straps 24 is made of a continuous seat belt type webbing 26 secured along substantially the entire length of the panel 12 and providing a loop or hand hold 28 on the end. Typically, the webbing 26 is stitched to the panel 12 along a substantial part of the long dimension of the webbing 26 so there is no tendency of the webbing 26, the stitching or the panel 12 to tear at their junction. Stitching of the inner pull straps 24 begins at a reinforcing pad 30 and proceeds toward the foot end of the device 10 for purposes more fully apparent hereinafter. As shown best in FIG. 1, the straps 24 run down in the inside of the evacuation device 10 from the head end to adjacent the foot end 16. Adjacent the foot end 16, the webbing 26 is folded, stitched and passed over the edge of the panel 12 to the outside of the device 10 and stitched adjacent the edge to provide a series of hand holds 32.

A series of hand holds 32 along both sides of the panel 12 allow four or six workers to grasp the device 10, lift the victim and then walk away from the injury site thereby manually carrying the victim. As shown best in FIG. 5, the hand holds 32 are provided by a strip of seat belt type webbing 34 parallel to the edge of the panel 12. The webbing 34 is stitched at spaced locations to the panel 12 providing the hand holds 32 therebetween. When the evacuation device 10 is not being used, the webbing 34 lies flat against the panel 12 and appears to be a simple reinforcement of the panel edge. In fact, the webbing 34 provides the hand holds 32 which are essential for manually carrying the victim.

It is also desirable to have the capability of lifting the device 10 upwardly or lowering the victim downwardly, as with a helicopter or crane. This can be accomplished with the victim in a vertical attitude simply by passing a rope or other attachment through the loops 28 of the lift straps 24. The rope is attached to a sling or other conventional attachment on the helicopter or crane and the victim is lifted upwardly or lowered downwardly.

It is also desirable to have the capability of lifting the victim upwardly or lowered downwardly in a tilted or horizontal attitude. To this end, a pair of lower lift straps 38 are attached to extend transversely of the panel 12 and are attached in any suitable manner, as by stitching. The lift straps 38 include seat belt type webbing 40 having loops 42 on the end. A rope or other attachment extends through the loops 42 and through the loops 28 of the inner straps 24. The rope is attached to a sling or other conventional attachment on the helicopter or crane so the victim can be lifted upwardly. It will be apparent that, as shown in FIG. 1, the inner straps 24 are longer than the lower lift straps 38. This implies the victim will be lifted in a tilted, head up, attitude. The exact orientation of the victim can be changed by effectively reducing the length of the inner straps 24, as by twisting them, or using the shorter, outer straps 24 which are about the same length as the lower lift straps 38 thereby positioning the victim horizontally.

Figure 6:
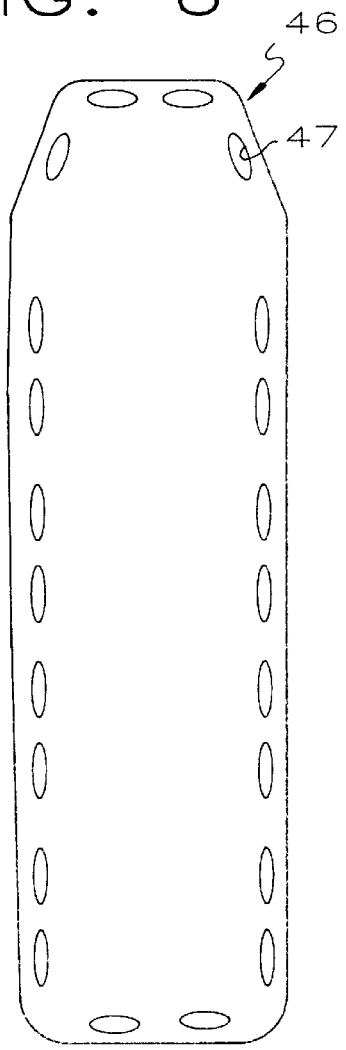
FIG. 6 is a plan view of a conventional back board used with the roll up evacuation device of this invention.
Figure 3:
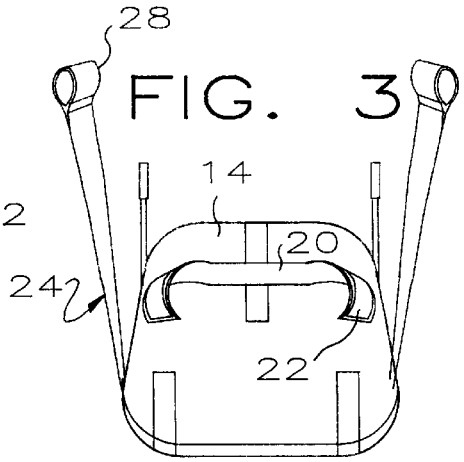
FIG. 3 is a view of the foot end of the roll up evacuation device of FIG. 1.

The victim is placed on a back board 46 (FIG. 6) having a series of conventional hand holds 47, the back board 46 is placed on the panel 12 and the victim is basically laced into the evacuation device 10. To this end, the device 10 includes a series of straps 48 extending transversely across the width of the panel 12 and spaced at desirable intervals along the length of the panel 12. The straps 48 are preferably on the inside of the panel 12 so they do not snag or increase friction when the evacuation device 10 is pulled along an underlying ground surface. Each of straps 48 includes a seat belt type webbing 50 stitched to the panel 12, an adjustable seat belt type buckle 52 and a seat belt type tongue 54. Those skilled in the art will recognize that the effective length of the webbing 50 may be adjusted by pulling on the end adjacent the buckle 52. At least some of the transverse straps wrapping the victim in the evacuation device 10 include diagonal or criss-cross straps 56 that, when buckled together, pull the device 10 downwardly on the victim's shoulders. This makes the victim's shoulders much less likely to snag on some obstruction if the device is towed on an underlying surface.

It is not a problem if the victim is much shorter than the panel 12 because the victim is placed on the spine board 46 and the device is designed to fit all existing spine board designs. The evacuation device 10 is simply rolled up around the victim with the victim's feet in the pouch 14. Any substantial excess length is accommodated in the field as is well known by users. For example, if the victim is going to be pulled out along an underlying surface, nothing need be done about the excess length. If the victim is going to be hoisted vertically or carried by workers, the excess length is folded so the doubled material rests on the spine board 46.

An important feature of this invention is color coding the straps 48, 56. The straps 48, 56 are preferably not all of one color. In the confusion that inevitably attends any emergency, it is easy to buckle the wrong ends 54 into the buckles 52. In this invention, adjacent straps 48, 56 are of different color so it will be readily apparent that the correct tongues 54 are being inserted into the correct buckles 52.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A device for the emergency evacuation of a human, comprising an elongate panel of bodily flexible material of a size to be wrapped about the human and having a head end, a foot end, an inside for juxtaposition to a victim, an outside and a longitudinal axis dividing the panel into generally equal halves;

a plurality of straps, on the inside of the panel, extending transverse to the longitudinal axis for wrapping the panel about the human;

a plurality of straps extending parallel to the longitudinal axis from adjacent one end of the panel to allow towing of the evacuation device along an underlying surface;

a pouch at the foot end of the panel for receiving feet of the human; and a strap adjacent the foot end of the panel for tieing the feet of the human together in the pouch thereby preventing splaying of the feet whereby the device may be pulled along an underlying ground surface without the human sliding toward the foot end of the device and minimizing snagging of the victim's feet.

2. The device of claim 1 wherein a first pair of the transverse straps are adjacent the head end of the panel, a first of the first pair of transverse straps comprising a first strap section, affixed to the panel and extending at an acute angle to the longitudinal axis, a second of the first pair of transverse straps comprising a second strap section, affixed to the panel and extending at an acute angle to the longitudinal axis, the first and second strap sections crossing on the panel.

3. The device of claim 1 wherein the straps comprise free ends, the free ends of the straps being of a variety of colors, the free ends of the straps to be fastened together being the same color and being of different color than the free ends of adjacent straps.

4. The device of claim 1 wherein the bodily flexible material is a fabric.

5. The device of claim 1 wherein the plurality of straps parallel to the longitudinal axis extend away from the head end of the panel.

6. The device of claim 5 wherein the panel includes generally parallel sides and the plurality of straps parallel to the longitudinal axis each include a segment attached to the panel adjacent the side and further comprising means providing hand holds adjacent the sides of the panel, the hand hold providing means comprising a strap overlying each of the segments and secured thereto at spaced apart locations providing a hand hold between adjacent locations.

7. A device for the emergency evacuation of a human, comprising an elongate panel of bodily flexible material of a size to be wrapped about the human and having a head end, a foot end, an inside, an outside and a longitudinal axis dividing the panel into generally equal halves;

a plurality of straps extending transverse to the longitudinal axis for wrapping the panel about the human including a first pair of transverse straps adjacent the head end of the panel, a first of the first pair of transverse straps comprising a first strap section, affixed to the panel and extending at an acute angle to the longitudinal axis, a second of the first pair of transverse straps comprising a second strap section, affixed to the panel and extending at an acute angle to the longitudinal axis, the first and second strap sections crossing on the panel;

a plurality of straps extending parallel to the longitudinal axis from adjacent one end of the panel to allow towing of the evacuation device along an underlying surface;

a pouch at the foot end of the panel for receiving feet of the human; and a strap adjacent the foot end of the panel for tieing the feet of the human together in the pouch thereby preventing splaying of the feet whereby the device may be pulled along an underlying ground surface without the human sliding toward the foot end of the device and minimizing snagging of the victim's feet.

8. The device of claim 2 wherein the panel provides an inside for juxtaposition to the victim and an outside, the transverse straps being on the inside of the panel.

9. The device of claim 7 wherein the straps comprise free ends, the free ends of the straps being of a variety of colors, the free ends of the straps to be fastened together being the same color and being of different color than the free ends of adjacent straps.

* * * * *